US007281785B2

(12) United States Patent
Palifka et al.

(10) Patent No.: US 7,281,785 B2
(45) Date of Patent: Oct. 16, 2007

(54) FLUID HANDLING IN DROPLET DEPOSITION SYSTEMS

(75) Inventors: Robert G. Palifka, Orford, NH (US); Edward R. Moynihan, Plainfield, NH (US)

(73) Assignee: Fujifilm Dimatix, Inc., Lebanon, NH (US)

( * ) Notice: Subject to any disclaimer, the term of this patent is extended or adjusted under 35 U.S.C. 154(b) by 283 days.

(21) Appl. No.: 10/943,560

(22) Filed: Sep. 17, 2004

(65) Prior Publication Data

US 2005/0034658 A1 Feb. 17, 2005

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS 3,950,761 A 4/1976 Kashio
3,961,337 A * 6/1976 Jung et al. ..... 374/89
4,038,667 A 7/1977 Hou et al.
4,080,608 A 3/1978 Stoneburner et al.
4,234,885 A 11/1980 Arway
4,286,272 A 8/1981 Schwob
4,287,523 A 9/1981 Thomas et al.
4,520,369 A 5/1985 Shackleton
4,542,386 A 9/1985 Delligatii et al.
4,542,390 A 9/1985 Bruning et al.
4,555,719 A 11/1985 Arway et al.
4,654,676 A 3/1987 Itano et al.
4,700,205 A 10/1987 Rich et al.
4,736,774 A 4/1988 Vonasek
4,737,801 A 4/1988 Ichihashi et al.
4,739,347 A 4/1988 Ishikawa et al.
4,882,596 A 11/1989 Tsuzuki et al.
5,343,226 A 8/1994 Niedermeyeyr et al.
5,367,328 A * 11/1994 Erickson ..... 347/7
5,380,164 A 1/1995 Fry et al.
5,434,605 A * 7/1995 Osborne ..... 347/23
5,489,925 A 2/1996 Brooks et al.
5,552,815 A 9/1996 Shimoda
5,598,198 A 1/1997 Taylor et al.
5,691,753 A 11/1997 Hilton
5,719,608 A 2/1998 Sabonis et al.
5,719,609 A 2/1998 Hauck et al.
5,734,401 A 3/1998 Clark et al.
5,737,001 A 4/1998 Taylor
5,796,419 A 8/1998 Clark et al.
5,819,799 A 10/1998 O'Dell
5,880,748 A 3/1999 Childers et al.
5,903,293 A 5/1999 Nikkels et al.
5,923,353 A 7/1999 Boyd et al.
5,963,237 A * 10/1999 Ikkatai et al. ..... 347/85
6,012,806 A 1/2000 De Ozazabal
6,099,112 A 8/2000 Olazabal (Continued)

*Primary Examiner*—An H. Do
(74) *Attorney, Agent, or Firm*—Fish & Richardson P.C.

(57) ABSTRACT

In general, in a first aspect, the invention features a droplet deposition system, including a jetting assembly comprising one or more modules capable of ejecting droplets, a plurality of conduits in fluid communication with the jetting assembly, and a valve coupled to the conduits and adjustable between a first state in which fluid flow through the conduits is substantially prevented and a second state in which fluid flow through the conduits is allowed.

11 Claims, 8 Drawing Sheets

U.S. PATENT DOCUMENTS

| | | | |
|---|---|---|---|
| 6,116,723 | A | 9/2000 | Childers |
| 6,172,694 | B1 | 1/2001 | Droege et al. |
| 6,199,976 | B1 | 3/2001 | Sasada |
| 6,209,997 | B1 | 4/2001 | Duong et al. |
| 6,234,617 | B1 | 5/2001 | Niedermeyer et al. |
| 6,267,473 | B1 | 7/2001 | Smith |
| 6,302,516 | B1 | 10/2001 | Brooks et al. |
| 6,315,402 | B1 | 11/2001 | Kawase |
| 6,322,207 | B1 | 11/2001 | Hall et al. |
| 6,386,689 | B1 | 5/2002 | Sasada |
| 6,390,611 | B1 | 5/2002 | Kobayashi et al. |
| 6,508,545 | B2 | 1/2003 | Dowell et al. |
| 6,551,079 | B1 | 4/2003 | Iwata et al. |
| 6,568,799 | B1 | 5/2003 | Yang et al. |
| 6,612,690 | B1 | 9/2003 | Wallace et al. |
| 6,685,307 | B2 | 2/2004 | Dowell et al. |
| 6,726,313 | B1 | 4/2004 | Oda et al. |
| 6,733,114 | B2 | 5/2004 | Kobayashi et al. |
| 6,764,169 | B2 | 7/2004 | Hall et al. |
| 6,776,467 | B2 | 8/2004 | Yamazaki et al. |
| 2003/0011668 | A1* | 1/2003 | Yoshida ..... 347/86 |

* cited by examiner

100

200

300

FLUID HANDLING IN DROPLET DEPOSITION SYSTEMS

TECHNICAL FIELD

This invention relates to fluid handling systems, and more particularly to fluid handling in droplet deposition systems.

BACKGROUND

Inkjet printers are one type of apparatus for depositing drops on a substrate. Ink jet printers can include a jetting assembly having one or more printhead modules. Printhead modules include an ink path linking an ink supply with a nozzle path. In some systems, ink is supplied to the jetting assembly from a remote ink supply. The nozzle path terminates in a nozzle opening from which ink droplets are ejected. Ink droplet ejection is typically controlled by pressurizing ink in the ink path with an actuator, which may be, for example, a piezoelectric deflector, a thermal bubble jet generator, or an electrostatically deflected element. Ink in the ink supply that feeds the nozzle path can be held under a negative pressure. This negative pressure can reduce leakage of ink from a nozzle opening when the nozzle is not activated.

A typical printhead module has an array of ink paths with corresponding nozzle openings and associated actuators. Droplet ejection from each nozzle opening can be independently controlled. In a drop-on-demand printhead module, each actuator is fired to selectively eject a drop at a specific pixel location of an image as the jetting assembly and a printing substrate are moved relative to one another. In high performance printhead modules, the nozzle openings typically have a diameter of 50 microns or less, e.g. around 25 microns, are separated at a pitch of 100-300 nozzles/inch, have a resolution of 100 to 3000 dpi or more, and provide drops with a volume of about 1 to 120 picoliters (pl) or less. Drop ejection frequency is typically about 10 kHz or more.

A piezoelectric actuator has a layer of piezoelectric material, which changes geometry, or bends, in response to an applied voltage. The bending of the piezoelectric layer pressurizes ink in a pumping chamber located along the ink path. Piezoelectric ink-jet printhead modules are also described in Fishbeck et al U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In general, in a first aspect, the invention features a droplet deposition system, including a jetting assembly comprising one or more modules capable of ejecting droplets, a plurality of conduits in fluid communication with the jetting assembly, and a valve coupled to the conduits and adjustable between a first state in which fluid flow through the conduits is substantially prevented and a second state in which fluid flow through the conduits is allowed.

In general, in a further aspect, the invention features a valve for controlling fluid flow though a plurality of tubes connected to a jetting assembly, the valve including an actuator mechanically coupled to the tubes, the actuator being adjustable between a first state in which the valve compresses a portion of each tube substantially preventing flow through the tubes, and a second state in which fluid flow through the tubes is allowed.

Embodiments of the droplet deposition system and/or valve may include one or more of the following features. The droplet deposition system can further include a pump in fluid communication with at least some of the conduits. The droplet deposition system can also include a fluid supply in fluid communication with at least some of the conduits. The pump can be configured to pump fluid from the fluid supply to the jetting supply. The fluid supply can be an ink supply. In some embodiments, the pump is a vacuum pump configured to pump gas from the jetting assembly. The conduits can include tubes, which can be flexible tubes. The valve can be configured to compress a portion of the flexible tubes in the first state. The modules can be drop-on-demand ink jet printhead modules (e.g., drop-on-demand ink jet printhead modules including a piezoelectric actuator). The droplet deposition system can include a print enclosure substantially enclosing the jetting assembly. The valve can be operable from outside the print enclosure. The valve can include an element in contact with the portion of each tube, wherein in the first state the actuator compresses the tubes by pressing the element against the tubes. A surface of the element in contact with the portion of each tube can be curved. In some embodiments, the valve can include a pair of elements, each in contact with one or more of the tubes, wherein in the first state the actuator compresses the tubes by pressing the elements against the tubes. The elements can be located on opposite sides of the actuator. The valve can include a housing comprising one or more openings through which the tubes can be placed. The actuator can include a camshaft configured to rotate between a first position and a second position corresponding to the first and second states, respectively. The first and second positions can correspond to a 90 degree rotation of the camshaft about a shaft axis. The fluid is a liquid (e.g., ink) or a gas (e.g., air). The valve can also include a lever coupled to the actuator with which the actuator can be mechanically switched between the first and second states. Alternatively, or additionally, the valve can include a switch coupled to the actuator with which the actuator can be electromechanically switched between the first and second states.

Embodiments of the invention may include one or more of the following advantages. In some embodiments, droplet deposition systems can be readily serviced with minimal fluid spillage and waste. For example, using a valve that simultaneously shuts off the supply of liquid and vacuum lines to all printhead modules in a jetting assembly can reduce (e.g., prevent) liquid leakage from the modules while the jetting assembly is offline, e.g., during servicing of the jetting assembly. Leakage can be reduced (e.g., prevented) when one or more fluid lines are detached from, e.g., a liquid (e.g., ink) supply or a vacuum pump.

Systems utilizing valves can readily conform to various agency standards (e.g., Occupational Health and Safety Agency (OSHA) standards). As an example, in certain industrial environments, OSHA work rules can require that a system be completely de-energized before any access panel is opened on any part of a system. Where a valve actuator can be accessed without opening a panel of a print enclosure, all supply and/or pneumatic lines to a jetting assembly within the print enclosure can be de-energized without opening the print enclosure. Accordingly, systems utilizing such valves can conform to the OSHA standards while still being relatively easy to operate.

Valves used to close multiple tubes can operate without valve components contacting fluid in the tubes. For example, valves can operate by controlling compression of a portion of the tubes. Accordingly, components of the valve contact the outer surface of the tube, and do not contact fluid carried within the tube. This may reduce spillage of fluids at the valve and/or may reduce the effects of interactions that may occur between the valve components and the tubes, such as rusting of valve components and/or valve components becoming gummed up with fluid residue.

In some embodiments, valves can be operated through numerous cycles without substantially reducing the life of the tubes. For example, mechanical components of a valve can compress and open portions of the tubes without imparting substantial stress on the tubes. Accordingly, wear on the tubes associated with opening and closing the valve can be reduced.

Furthermore, valves can be operated without imparting significant stress on other components of the print system via the tubes. For example, where valves use a rotating element, such as a camshaft, to apply a compressive force to tubes, the rotational force can be decoupled from the tubes so that the tubes do not creep significantly as the valve opens and closes the tubes. Reduced stresses on valve components can enhance the operating lifetime of a valve.

The details of one or more embodiments of the invention are set forth in the accompanying drawings and the description below. Other features and advantages of the invention will be apparent from the description and drawings, and from the claims. Certain references are incorporated herein by reference. In case of conflict, the present specification will control.

DESCRIPTION OF DRAWINGS

FIG. 3A is an isometric view of the valve, while FIGS. 3B and 3C are cross-sectional views of a portion of the valve when the valve is open and closed, respectively.

Like reference symbols in the various drawings indicate like elements.

DETAILED DESCRIPTION

Figure 1A:
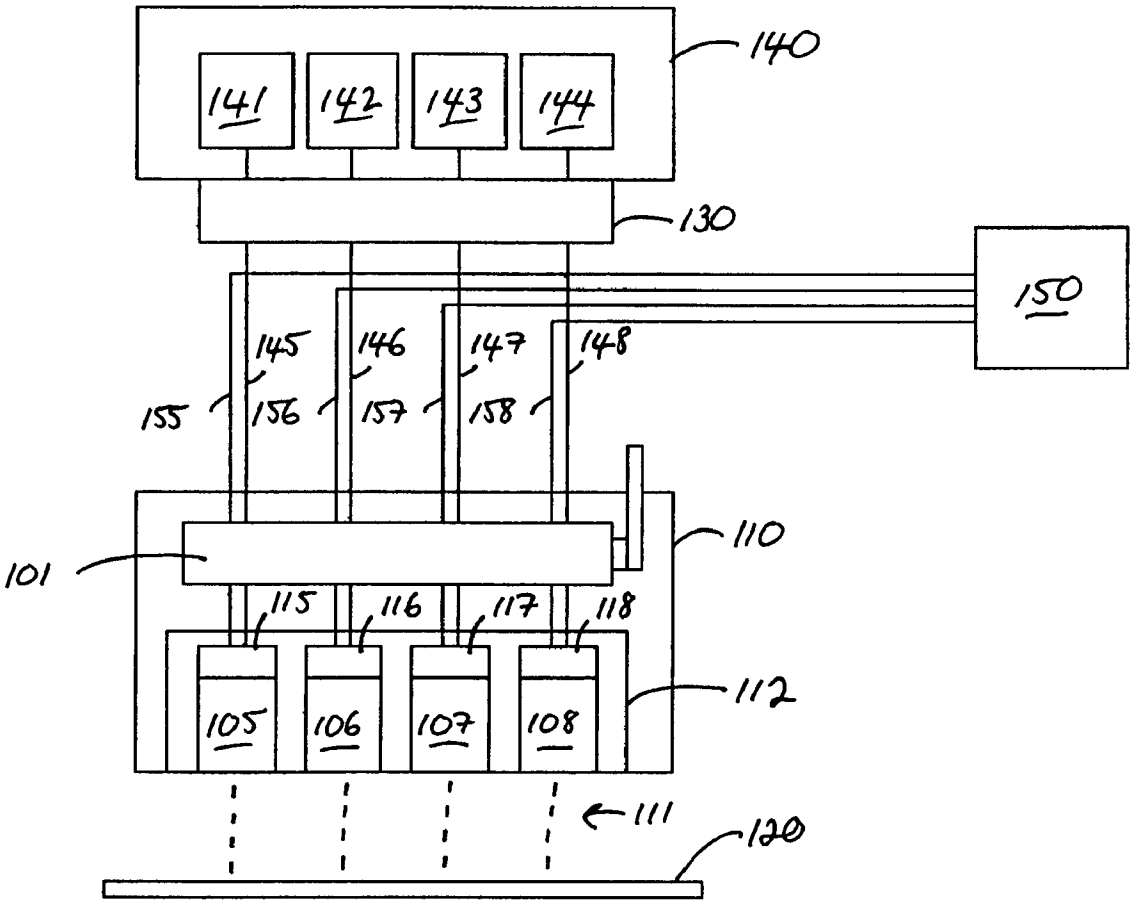
FIG. 1A is a schematic diagram of an ink jet printing system.
Figure 1B:
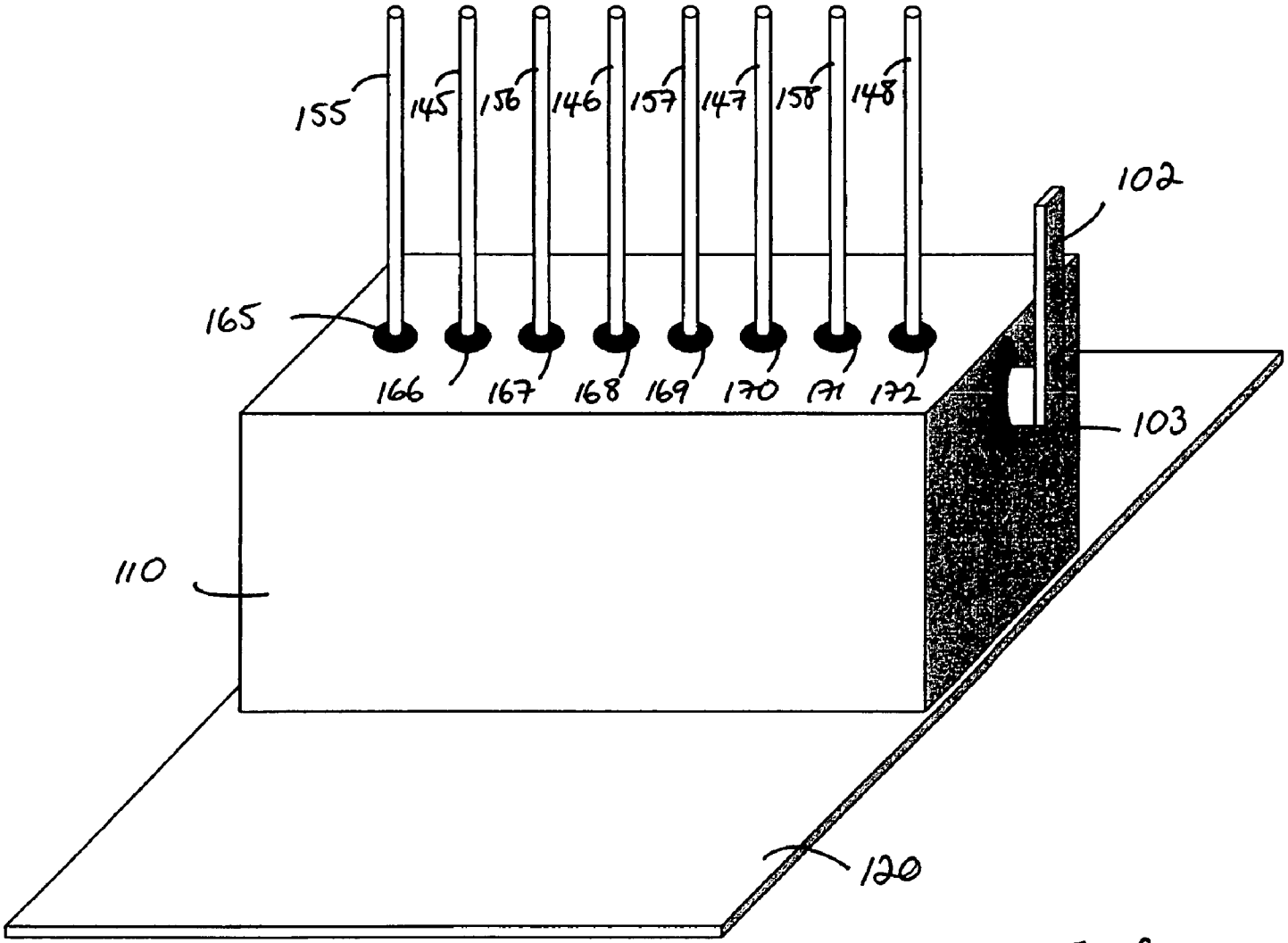
FIG. 1B is a perspective view of components of the ink jet printing system shown in FIG. 1A.

Referring to FIGS. 1A and 1B, a print system 100 includes a print enclosure 110 that includes a jetting assembly 112 that deposits ink droplets 111 onto a substrate 120, forming an image on substrate 120. A pumping system 130 (e.g., including one or more peristaltic pumps) supplies ink from ink containers 141-144 in a remote ink supply 140 to jetting assembly 110 through ink supply tubes 145-148, respectively. In addition, pneumatic tubes 155-158 connect a vacuum pump 150 to jetting assembly 110. During operation, vacuum pump 150 pumps air from ink reservoirs 115-118 in jetting assembly 110, maintaining a negative pressure on ink present in jetting assembly 110. This negative pressure can reduce ink leakage from jetting assembly 110. A valve 101 is also housed within print enclosure 110. Valve 101 controls fluid flow through ink supply tubes 145-148 and pneumatic tubes 155-158.

Jetting assembly 112 includes four printhead modules 105-108. Each printhead module includes a plurality of nozzle openings (e.g., 128 or 256 nozzle openings) through which ink can be ejected. Jetting assembly 112 also includes four ink reservoirs 115-118, which receive ink from ink supply 140 and deliver ink to printhead modules 105-108, respectively. In some embodiments, each module ejects different color ink (e.g., cyan, magenta, yellow, and black, or red, green, blue, and black), enabling print system 100 to print full color images on substrate 120. Alternatively, in some embodiments, each module can eject the same ink color. Suitable inks can include solvent-based inks (e.g., aqueous inks or organic solvent inks), UV-curable inks, and/or hot-melt inks.

In general, the composition of substrate 120 can vary, and is typically selected based on the specific application for which print system 100 is used. Examples of substrates include paper (e.g., white paper or newsprint paper), cardboard, polymer films, wood products and/or food products. Furthermore, the size of the substrate can vary depending on the application. Printing can be completed in a single pass of the jetting assembly relative to the substrate, or in multiple passes. In some embodiments, substrate 120 is a continuous web that is conveyed by a web transport system relative to jetting assembly 112, which is fixed relative to the web transport system. Alternatively, or additionally, jetting assembly 112 can be mounted on a movable stage that scans the jetting assembly back and forth over the substrate during printing.

Print enclosure 110 substantially encloses jetting assembly 112, leaving only the portion of the assembly that faces substrate 120 exposed. Accordingly, operator access to jetting assembly 112 is limited. Typically, an operator should remove one or more panels of print enclosure 110 to access assembly 112. Print enclosure 110 includes openings 165-172, through which tubes 145-148 and 155-158 are fed. In addition, a stop lever 102 for valve 101 protrudes through another opening 103 on a side of print enclosure 110. In general, print enclosure 110 can include additional openings through which other lines (e.g., electrical lines) can be fed.

As discussed previously, valve 101 controls fluid flow through ink supply tubes 145-148 and pneumatic tubes 155-158. Valve 101 can be switched between an "open" and a "closed" state by operating a stop lever 102 that protrudes through opening 103 in print enclosure 110. Valve 101 can be switched between the open and closed states while jetting assembly 112 is still fully enclosed by print enclosure 110.

The valve is placed in the open state during normal operation of print system 100, where all of ink supply tubes 145-148 allow ink to flow from ink supply 140 to jetting assembly 110. Furthermore, in the open state, all pneumatic lines allow vacuum pump 150 to reduce pressure on ink in reservoirs 115-118. In the closed position, ink tubes 145-148 and pneumatic tubes 155-158 are blocked, substantially preventing ink flow from ink supply 140 to reservoirs 115-118 and substantially preventing vacuum pump 150 from drawing a vacuum on ink in reservoirs 115-118. In embodiments, in the closed state, no ink leaks out of the printhead module nozzle openings. Typically, valve 101 is placed in the closed state during maintenance or storage of jetting assembly 112, for example.

As discussed below, in some embodiments, valve 101 operates by compressing tubes 145-148 and 155-158. Accordingly, tubes 145-148 and 155-158 should be formed from a flexible, elastic material such as an extruded polymer (e.g., an organic or silicone polymer). The material should be sufficiently flexible so that it can compress sufficiently to occlude the tube channel without significant wear that could substantially shorten the tube's operating life. Furthermore, the tube should be sufficiently flexible so that once a compressive force placed on the tube is released the tube substantially regains its pre-compression form, reopening the tube channel.

Figure 2:
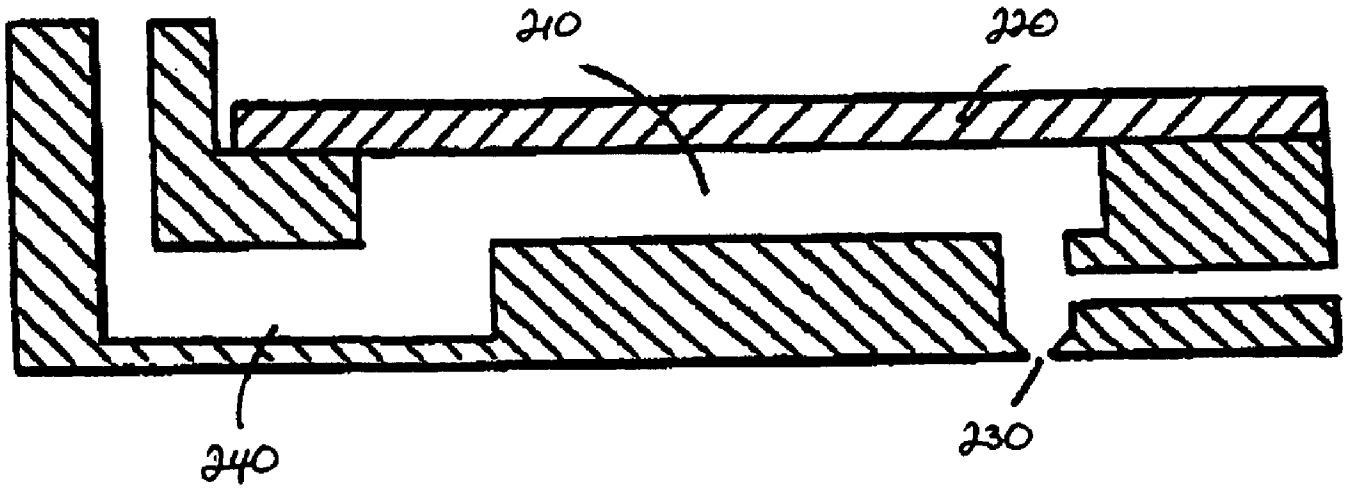
FIG. 2 is a cross-sectional view of a printhead module.

Referring to FIG. 2, an example of a printhead module is module 200, which has piezoelectric element 220, which pressurizes ink in a pumping chamber 210 for ejection through a nozzle opening 230. Ink is supplied to pumping chamber 210 from a reservoir (not shown in FIG. 2) via a supply path 240. In embodiments, the printhead includes a heater to heat the media to a desired viscosity to facilitate jetting. A suitable printhead module is the NOVA printhead, available from Spectra, Inc., Hanover, N.H. Suitable piezoelectric inkjet printhead modules are also discussed in Fishbeck '227, Hine '598, Moynihan '346 and Hoisington '391, incorporated, supra and WO 01/25018, the entire contents of which is hereby incorporated by reference.

Figure 3A:
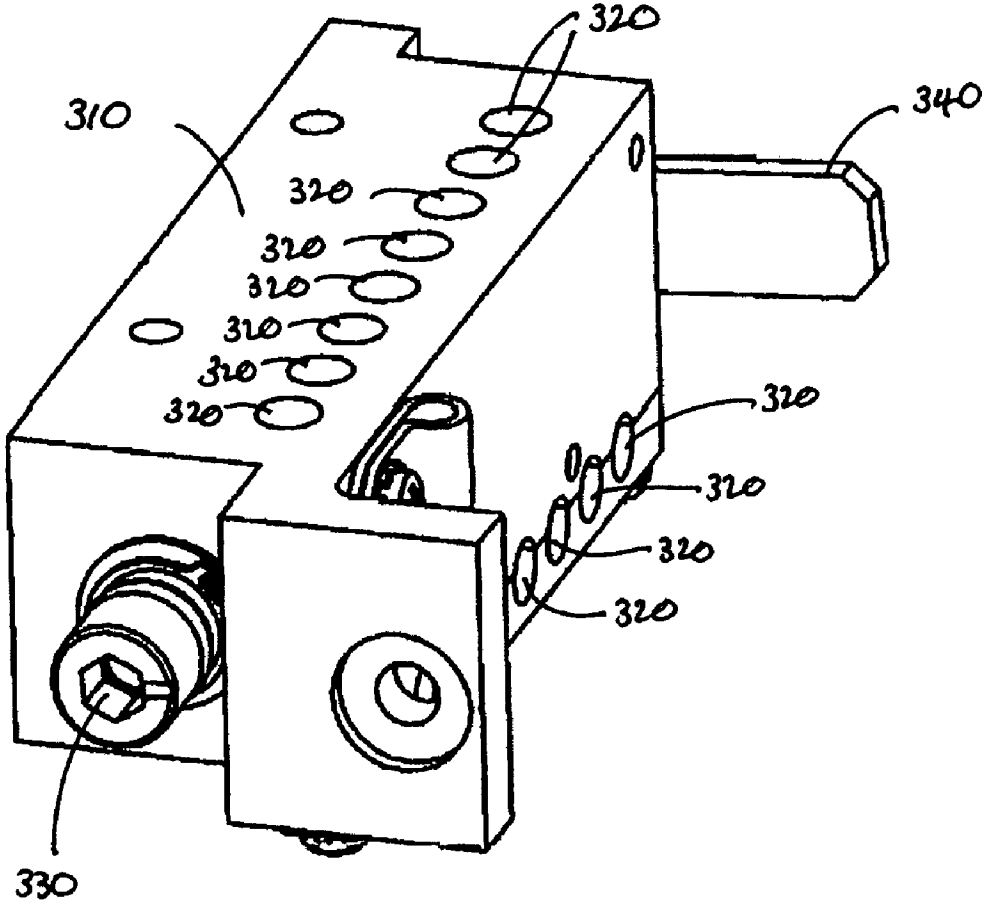
FIGS. 3A-3C are diagrams showing aspects of an embodiment of a valve.
Figure 3C:
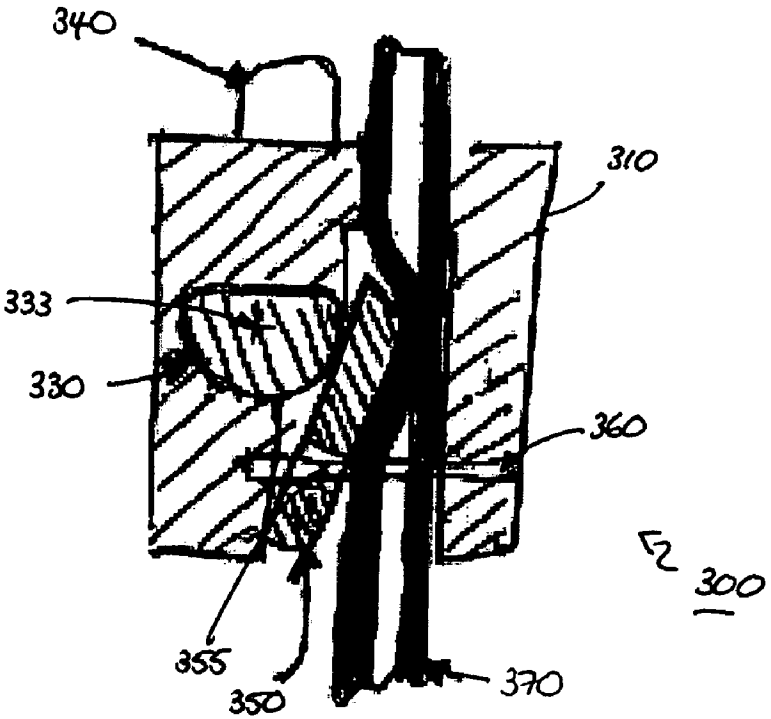
Figure 3B:
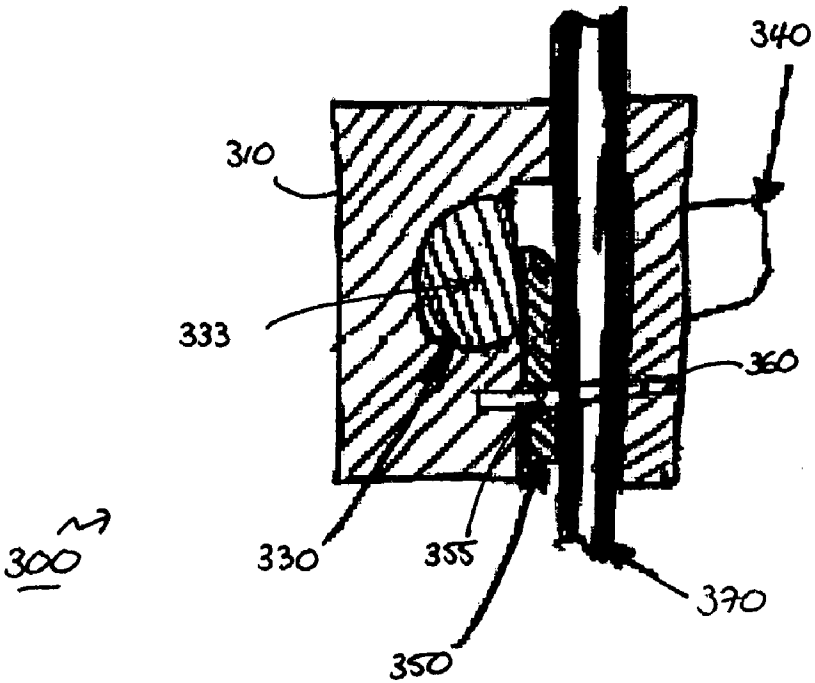

Referring to FIGS. 3A-3C, an example of a valve is valve 300, which includes a valve housing 310 having eight openings through which the ink supply tubes and pneumatic tubes can be placed. The openings are arranged in a line and have terminals that are denoted by numeral 320 in FIG. 3A. Valve 300 further includes a camshaft 330 configured to rotate about an axis 333 running parallel to the line of openings. Camshaft 330 can be coupled to valve housing 310 by, e.g., ball bearings. A stop lever 340 is attached to camshaft 330, allowing an operator to rotate camshaft 330 about axis 333. A pinch plate 350 is positioned between camshaft 330 and tubes inserted into the openings in the valve housing, e.g., tube 370 (in FIGS. 3B and 3C). At one end, pinch plate 350 is attached to a pin 360 and the pinch plate pivots on an axis 355 at the point of attachment.

Rotating camshaft 330 between a first position, shown in FIG. 3B, and a second position, shown in FIG. 3C, allows valve 300 to control flow through, e.g., tube 370. In the first position, camshaft 330 allows pinch plate 350 to rest against a surface of the cam surface closest to shaft axis 333, leaving tube 370 open and allowing fluid to flow. In the second position, stop lever is rotated 90° relative to the first position, and camshaft 330 pushes pinch plate 350 against tube 370, closing the inner diameter of the tube and substantially preventing fluid flow through the tube. Valve housing 330 may include one or more protrusions to constrain the range of motion of stop lever 340 (e.g., protrusions that stop the lever in the first and second positions).

Camshaft 330 can have a curved cross-sectional profile (e.g., a D-shaped profile), applying a continuously variable force to pinch plate 350 as it is adjusted between the first and second positions. Camshaft 330 can be formed from a relatively rigid material, such as a metal (e.g., aluminum) or alloy (e.g., stainless steel), a rigid polymer (e.g., Teflon®, nylon, PEEK™), or a ceramic.

Furthermore, in embodiments, the surface of pinch plate 350 that contacts tube 370 can be curved, limiting stresses applied to the tube as the camshaft is adjusted between the first and second positions. In general, pinch plate 350 can also be formed from a relatively rigid material, such as a metal or alloy, or a rigid polymer. Pinch plate 350 should be more rigid than tube 370 so that it does not substantially deform when compressing the tube.

Figure 4A:
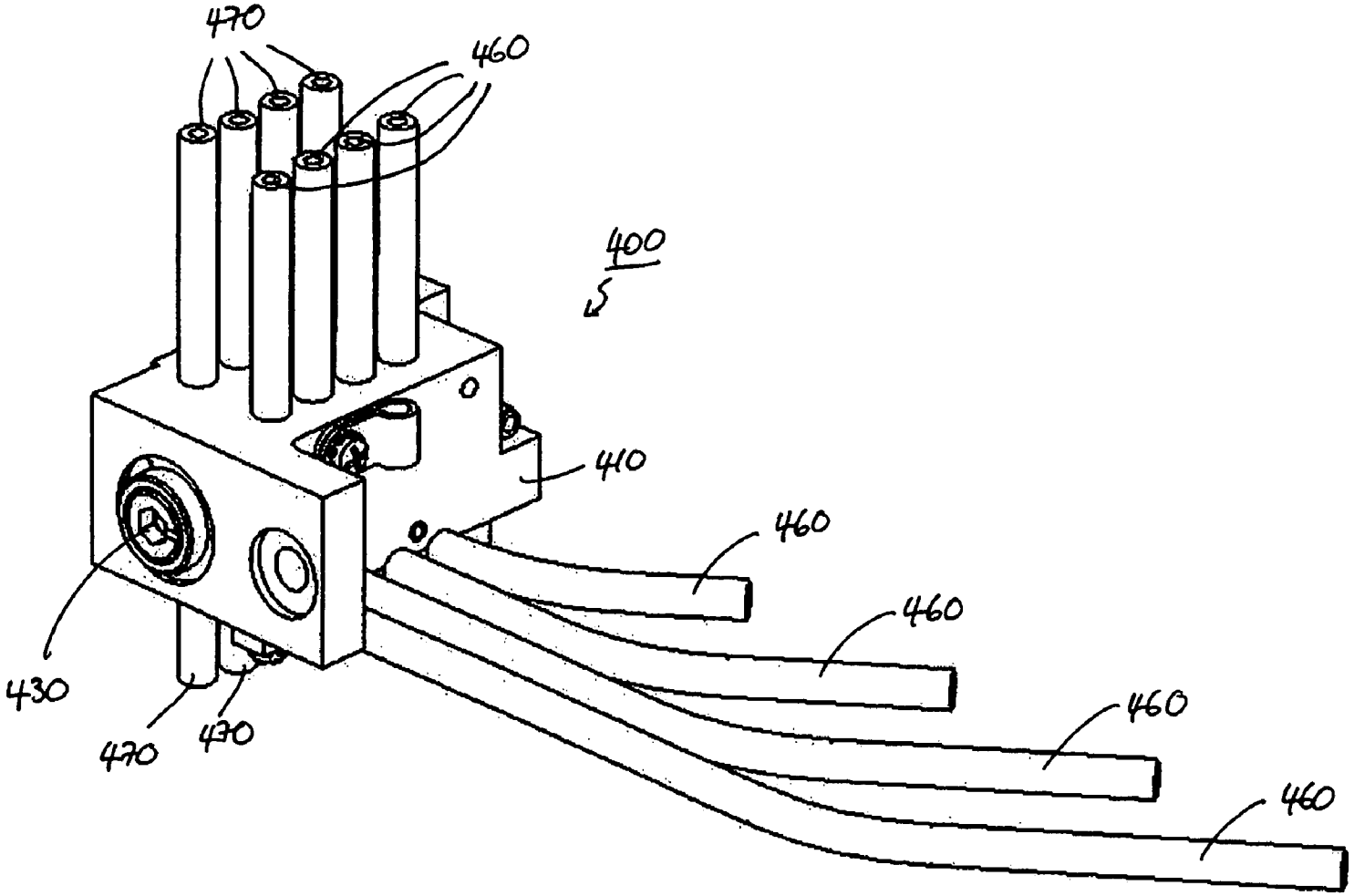
FIG. 4A is an isometric view of another embodiment of a valve.
Figure 4B:
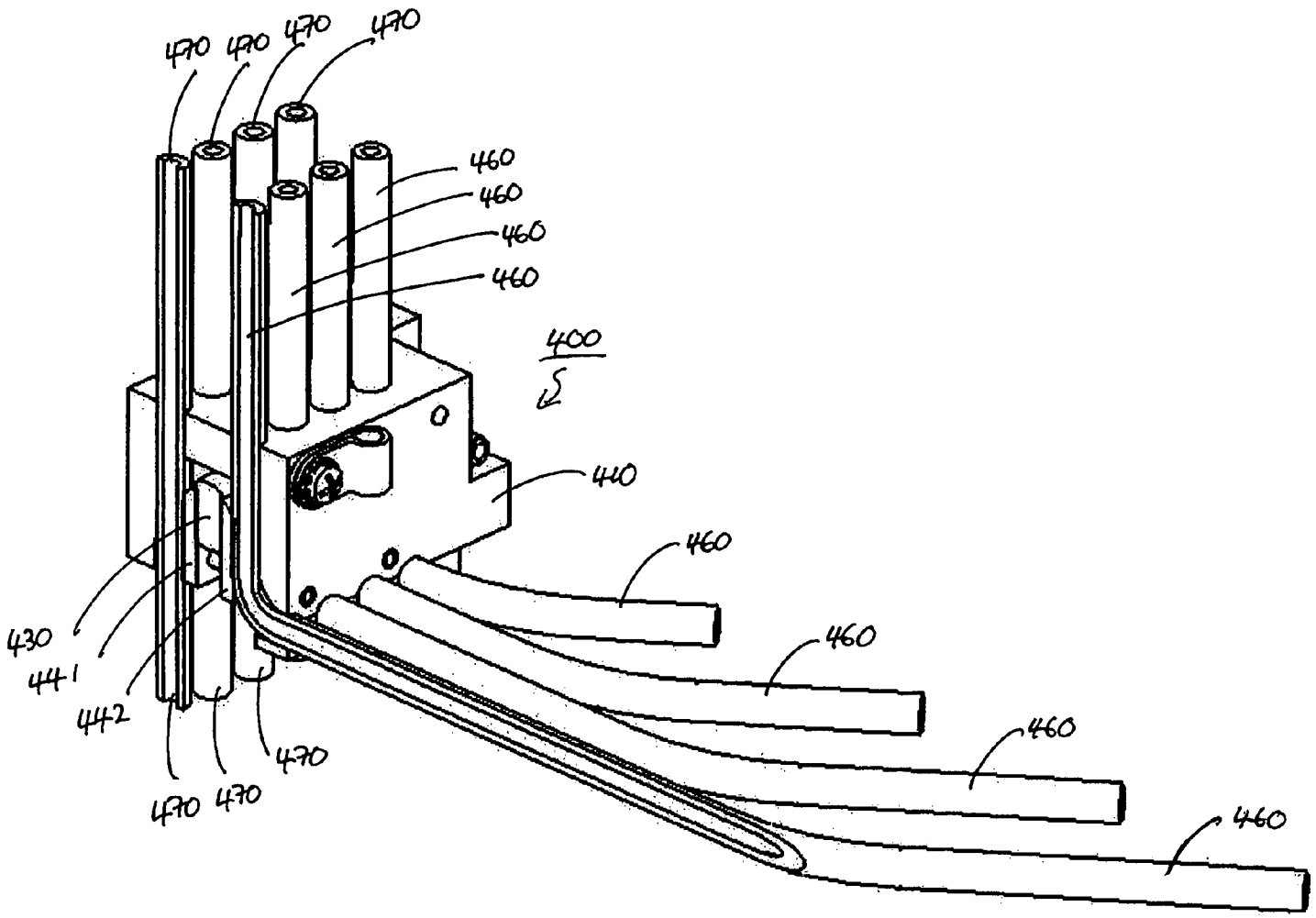
FIGS. 4B and 4C are a front section and top section of the valve shown in FIG. 4A, respectively.
Figure 4C:
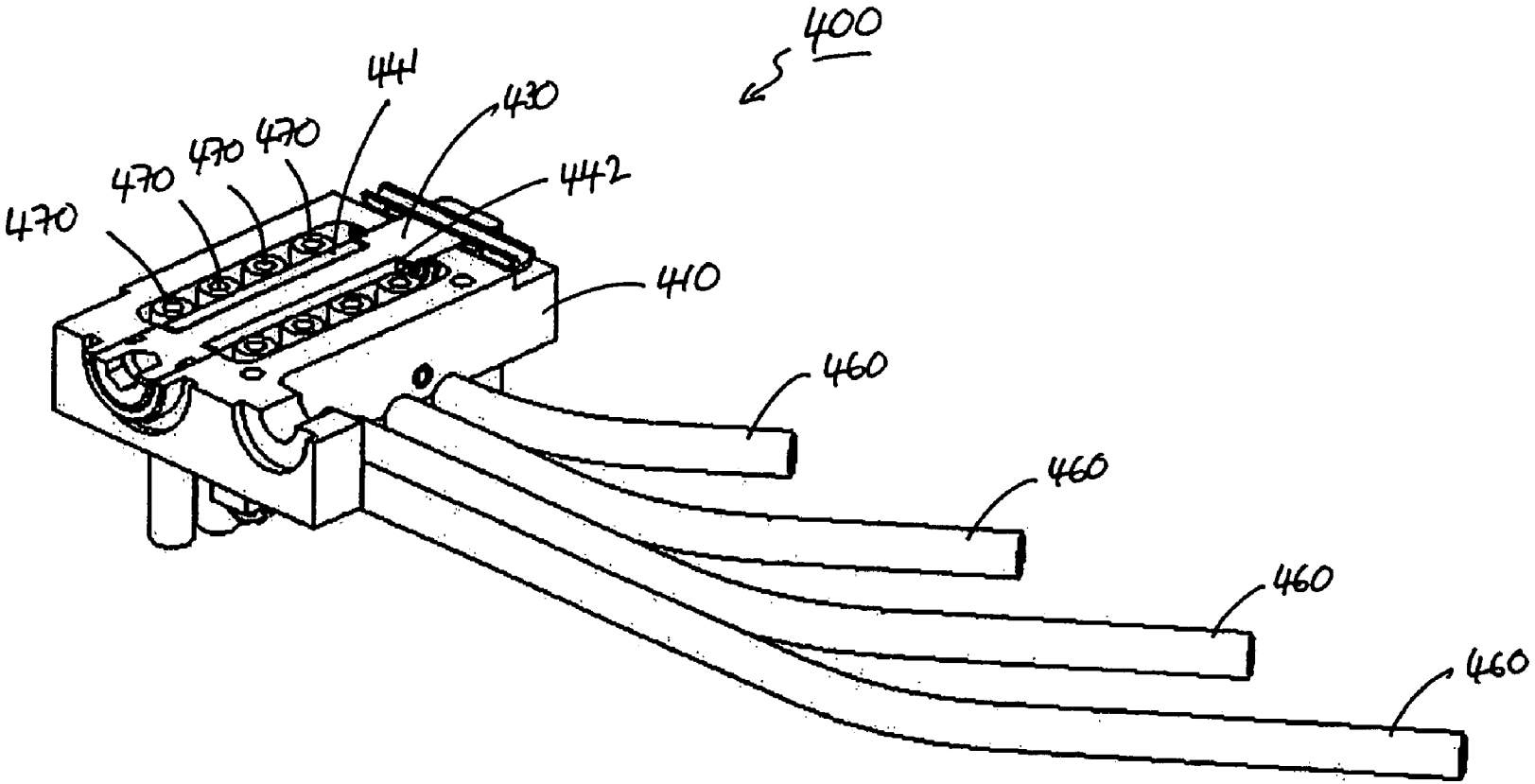

Referring to FIGS. 4A-4B, in another example, a valve 400 includes a housing 410 having openings arranged in two lines, instead of one. The openings are arranged so that four tubes 460 (e.g., pneumatic tubes) are arranged on one side of a camshaft 430, while four other tubes 470 (e.g., ink supply tubes) are arranged on the other side of the actuator. Valve 400 includes two pinch plates, 441 and 442, positioned on opposite sides of camshaft 430. In FIGS. 4A-4C, valve 400 is shown in a first position in which tubes 460 and 470 are all open. When camshaft 430 is rotated 90° from this position, it forces pinch plates 441 and 442 to compress tubes 460 and 470, respectively, thereby closing the tubes. Less torque may be needed to open and close a valve having tubes positioned on either side of the camshaft, as in valve 400, compared with a valve having tubes positioned only on one side of the camshaft. Moreover, positioning tubes on both sides of the camshaft may provide a more compact valve compared with a valve having tubes positioned only on one side of the camshaft.

While the valves shown in FIGS. 3A-3C and 4A-4C are manually actuated, valves can also be electromechanically actuated. For example, in some embodiments, the camshafts used to open and closed valves 300 and 400 can be coupled to an electric motor that rotates the camshaft when switch on.

Moreover, while the valves shown in FIGS. 3A-3C and 4A-4C are actuated by way of a camshaft, other types of actuation can also be used. For example, an actuator that extends linearly to engage the pinch plate(s) and press them against the tubes may be used.

In some embodiments, an actuator may be used that engages the tubes directly, without using additional components (e.g., a pinch plate) to couple force from the actuator to the tubes.

While print system 100 includes a jetting assembly with four printhead modules, in general, the number of printhead modules in a jetting assembly can vary as desired. For example, jetting assemblies can include more than four printhead modules (e.g., eight printhead modules, 12 printhead modules or more).

Moreover, the number of fluid lines connecting to a jetting assembly that are opened and closed by the valve can vary. In general, the number of fluid lines connecting to a jetting assembly depends on the number of printhead modules in the assembly, as well as on the different fluids that need to transported to an from the printhead modules. For example, in addition to ink lines and pneumatic lines that can be used in a print system, some printhead modules may utilize pressure lines (to carry, e.g., pressured gas for flushing the printhead module). Furthermore, the valve may control additional lines to the jetting assembly, e.g., for cleaning the jetting assembly.

While print system 100 is used for printing images on a substrate, in general, such systems can be used to eject droplets for other purposes. For example, such systems can be used to in a manufacturing environment to precisely deposit materials on a substrate. An example is in the display manufacturing industry, where print systems can be used to deposit, e.g., organic light emitting diode materials or color filter materials to form an array of such materials on a substrate. Systems can also be used where precision metering of fluids is desired, such as in a laboratory environment, where print systems can be used to precisely dispense different materials.

A number of embodiments of the invention have been described. Nevertheless, it will be understood that various modifications may be made without departing from the spirit and scope of the invention. Accordingly, other embodiments are within the scope of the following claims.

What is claimed is:

1. A valve for controlling fluid flow though a plurality of tubes connected to a jetting assembly, the valve comprising:

an actuator mechanically coupled to the tubes, the actuator being adjustable between a first state in which the valve compresses a portion of each tube substantially preventing flow through the tubes, and a second state in which fluid flow through the tubes is allowed; and a pair of elements, each in contact with one or more of the tubes, wherein in the first state the actuator compresses the tubes by pressing the elements against the tubes, the elements being located on opposite sides of the actuator.

2. The valve of claim 1, further comprising an element in contact with the portion of each tube, wherein in the first state the actuator compresses the tubes by pressing the element against the tubes.

3. The valve of claim 2, wherein a surface of the element in contact with the portion of each tube is curved.

4. The valve of claim 1, further comprising a housing comprising one or more openings through which the tubes can be placed.

5. The valve of claim 1, wherein the actuator comprises a camshaft configured to rotate between a first position and a second position corresponding to the first and second states, respectively.

6. The valve of claim 5, wherein the first and second positions correspond to a 90 degree rotation of the camshaft about a shaft axis.

7. The valve of claim 1, wherein the fluid is a liquid.

8. The valve of claim 7, wherein the liquid is ink.

9. The valve of claim 1, wherein the fluid is a gas.

10. The valve of claim 1, further comprising a lever coupled to the actuator with which the actuator can be mechanically switched between the first and second states.

11. The valve of claim 1, further comprising a switch coupled to the actuator with which the actuator can be electromechanically switched between the first and second states.

* * * * *